US006450135B1

(12) United States Patent
Araki

(10) Patent No.: US 6,450,135 B1
(45) Date of Patent: Sep. 17, 2002

(54) TWO-STROKE INTERNAL COMBUSTION ENGINE

(75) Inventor: Tsuneo Araki, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/504,145

(22) Filed: Feb. 15, 2000

(30) Foreign Application Priority Data

Feb. 19, 1999 (JP) ..... 11-041513

(51) Int. Cl.[7] ..... F02B 33/04
(52) U.S. Cl. ..... 123/73 B
(58) Field of Search ..... 123/73 B, 73 R, 123/73 A, 65 R, 73 PP

(56) References Cited

U.S. PATENT DOCUMENTS 3,687,118 A * 8/1972 Nomura ..... 123/73 R
4,075,985 A * 2/1978 Iwai ..... 123/73 B
4,194,470 A * 3/1980 Magner ..... 123/73 A

FOREIGN PATENT DOCUMENTS

JP 05033657 A 2/1993
JP 09125966 A 5/1997

* cited by examiner

*Primary Examiner*—Willis R. Wolfe
*Assistant Examiner*—Hyder Ali
(74) *Attorney, Agent, or Firm*—Baker Botts L.L.P.

(57) ABSTRACT

A two-stroke internal combustion engine has an air passageway for introducing air into a scavenging passageway communicating a combustion/actuating chamber disposed above a piston with a crankcase and an air-fuel supply passageway for introducing an air-fuel mixture from a carburetor into the combustion/actuating chamber. On the descending stroke of the piston, an exhaust port opens before a scavenging port formed at an upper end of the scavenging passageway opens, and an air-fuel mixture-feeding port disposed at a downstream end of the air-fuel supply passageway is opened a moment after the scavenging port is opened. Thus, air is introduced into the combustion/actuating chamber prior to the introduction of the air-fuel mixture.

8 Claims, 4 Drawing Sheets

TWO-STROKE INTERNAL COMBUSTION ENGINE

BACKGROUND OF THE INVENTION

The present invention relates to a two-stroke internal combustion engine of the type that is suited for use in a portable power working machine and, in particular, to a two-stroke internal combustion engine that is capable of minimizing the quantity of so-called blow-by, i.e., the quantity of the air-fuel mixture that is discharged without being utilized for the combustion.

A conventional two-stroke internal combustion engine which is commonly used in a portable power working machine such as a chain saw includes an ignition plug disposed at the head portion of the cylinder, and an intake port, a scavenging port and an exhaust port, which are opened and closed by a piston, located in the trunk portion of the cylinder. With such a two-stroke internal combustion engine, one cycle of the engine is accomplished by two strokes of the piston—there are no strokes exclusively assigned to the intake or exhaust.

More specifically, during the ascending stroke of the piston, an air-fuel mixture is inducted though the intake port into a crankcase below the piston. During the descending stroke, the air-fuel mixture in the crankcase is pre-compressed, producing a compressed gas mixture, which is then utilized during an initial part of the succeeding ascending stroke for exhausting the combustion gas from the exhaust port; i.e., the compressed gas mixture is blown into a combustion/actuating chamber, which is located above the piston at bottom dead center so as to expel the combustion gas toward the exhaust port. (Although the combustion/actuating chamber may be called a combustion chamber, an actuating chamber, a cylinder chamber, etc., those chambers are generically referred to in the present specification as "the combustion/actuating chamber"). In other words, since the scavenging of the combustion gas is effected by making use of the gas flow of the air-fuel mixture, the unburned air-fuel mixture is more likely to be mixed with the combustion gas (exhaust gas), thereby increasing the quantity of air-fuel mixture that is discharged into the atmosphere without being utilized for the combustion. Because of the discharge of unburned fuel components into the atmosphere, two-stroke cycle internal combustion engines are not only inferior to four-stroke cycle engines in fuel consumption but also are disadvantageous in that a large amount of environmentally undesirable components, such as HC (unburned components in a fuel) and CO (incomplete combustion components in a fuel) are included in the exhaust gas, as compared with four-stroke cycle engines. Therefore, even if a two-stroke engine is small in capacity, the influence of these undesirable components on environmental contamination should not be disregarded.

With a view to minimizing these problems, there have been various proposals for the two-stroke internal combustion engine, the proposals being featured in that air is introduced into the combustion/actuating chamber prior to the introduction of air-fuel mixture so as to scavenge the combustion gas (see, for example, Japanese Patent Unexamined Publications H9-125966 and H5-33657). However, even with these proposals, it is difficult to sufficiently reduce the quantity of blow-by. Additionally, the layout and structure of the parts of the engine, including the air-fuel supply passageway and air passageway, are not sufficiently regulated, thus causing the engine to increase in size. Therefore, the two-stroke internal combustion engines proposed in these publications are still required to be further improved for the purpose of mounting them on a portable power working machine.

BRIEF SUMMARY OF THE INVENTION

The present invention is directed to solving the aforementioned problems. It is, therefore, an object of the present invention to provide a two-stroke internal combustion engine that is capable of minimizing the quantity of the air-fuel mixture discharged without being utilized for combustion, of improving the fuel consumption and power of the engine, of reducing the content of poisonous components in the exhaust gas, and of rationally and compactly arranging the parts of the engine.

With a view to attaining the aforementioned objects, a two-stroke internal combustion engine, according to the present invention, has a cylinder, a piston received in the cylinder for reciprocating axial movement in ascending and descending directions and defining with the cylinder a combustion/actuating chamber, and a crankcase. A device is provided for producing an air-fuel mixture, and an air-fuel supply passageway is arranged to receive the air-fuel mixture from the air-fuel mixture producing device and supply it to the combustion/actuating chamber through an air-fuel mixture-feeding port opening to the combustion/actuating chamber. An exhaust passageway opens to the combustion/actuating chamber at an exhaust port, and a scavenging passageway communicates the crankcase with the combustion/actuating chamber and opens to the combustion/actuating chamber at a scavenging port. An air passageway is arranged for introducing ambient air into the scavenging passageway. With respect to the descending stroke of the piston, the exhaust port is positioned and configured to open before the scavenging port opens and the air-fuel mixture-feeding port is positioned and configured to open after the scavenging port opens. Therefore, air is introduced into the combustion/actuating chamber prior to the introduction of the air-fuel mixture into the combustion/actuating chamber.

In a preferred embodiment of the two-stroke internal combustion engine of the present invention, portions of the air passageway and the air-fuel supply passageway are arranged immediately adjacent each other and are provided, respectively, with a check valve. Advantageously, the portions of the air passageway and the air-fuel supply passageway are arranged one above the other axially of the engine.

It is further preferred that the air-fuel passageway and port are configured to expel the air-fuel mixture toward a combustion chamber at the top of the combustion/actuating chamber. In addition, it is desirable in a two-stroke internal combustion engine according to the present invention to provide a second air-fuel supply passageway arranged to receive the air-fuel mixture from the air-fuel mixture producing device and to discharge the air-fuel mixture into the crankcase.

In a desirable arrangement of a two-stroke internal combustion engine according to the present invention, the air-fuel mixture is produced by a carburetor that, which includes a portion of the air passageway and a portion of the air-fuel supply passageway, and each such portion has throttle valve, the respective throttle valves being interlocked with each other.

With the preferred embodiments of two-stroke internal combustion engine of the present invention as described above, external (ambient) air is inducted from the air passageway into the scavenging passageway and the crankcase upon each ascending stroke of the piston, so as to be stored therein at the end of the ascending stroke of the piston. At the same time, the air-fuel mixture is drawn in from the air-fuel-producing device into part of the crankcase so as to be stored therein.

When the air-fuel mixture inside the combustion/actuating chamber disposed above the piston is ignited and burns through the ignition thereof, the piston is caused to be pushed downwardly due to the generation of combustion gas. In the descending stroke of the piston, an exhaust port is opened first, and when the piston has further descended, the scavenging port formed at an upper end of the scavenging passageway is opened so as to allow the air which has been stored in the scavenging passageway and the crankcase and compressed by the piston is ejected from the scavenging port into the combustion/actuating chamber disposed above the piston, thereby allowing the combustion gas to be pushed toward the exhaust port by the air.

When the piston descends further after the scavenging port has been opened, the air-fuel mixture-feeding port is opened a moment after the scavenging port has been opened (for example, 10 degrees later in terms of the crank angle being suitable), thereby allowing a relatively condensed air-fuel mixture existing inside the air-fuel supply passageway to be expelled from the air-fuel mixture-feeding port into the combustion chamber at the top of the combustion/actuating chamber. The air-fuel mixture thus ejected is prevented from being mixed with the combustion gas due to the presence of an air layer that has been previously introduced therein in advance, thereby allowing the air-fuel mixture to revolve in the vicinity of the combustion chamber.

Thereafter, following the supply of air, a very lean air-fuel mixture comprising air and the air-fuel mixture is introduced from the scavenging port into the combustion/actuating chamber.

As mentioned above, since the air-fuel mixture-feeding port is opened a moment later than the scavenging port, thereby allowing a relatively condensed air-fuel mixture existing inside the air-fuel supply passageway to be blown out of the air-fuel mixture-feeding port toward the combustion chamber of the combustion/actuating chamber, the air-fuel mixture thus blown out is prevented from being mixed with the combustion gas due to the presence of an air layer that has been introduced therein in advance, thus enabling the air-fuel mixture to revolve in the vicinity of the combustion chamber. As a result, the quantity of blow-by, i.e., the quantity of air-fuel mixture discharged without being utilized for combustion can be reduced to as minimum as possible, and at the same time, the air-fuel mixture can be easily ignited, thus making it possible to improve the fuel consumption and to reduce the content of undesirable components in the exhaust gas.

Furthermore, the introduction of the condensed air-fuel mixture from the air-fuel mixture-feeding port to the combustion/actuating chamber can be always effected (even after the movement of the piston changes from the descending stroke to the ascending stroke) due to a difference in pressure between the combustion/actuating chamber and the air-fuel supply passageway, so that before the air-fuel mixture-feeding port is closed, the air-fuel mixture can be immediately drawn from the air-fuel mixture-feeding port into the combustion/actuating chamber through the air-fuel supply passageway (or the check valve thereof). As a result, the filling efficiency of the air-fuel mixture can be greatly improved, and at the same time, the power of the engine can be increased.

Furthermore, since portions of the air passageway and the air-fuel supply passageway are arranged immediately adjacent each other, the parts of engine can be rationally and compactly arranged, thus making it possible to easily mount the engine on a portable power working machine.

DESCRIPTION OF THE EMBODIMENT

Figure 1:
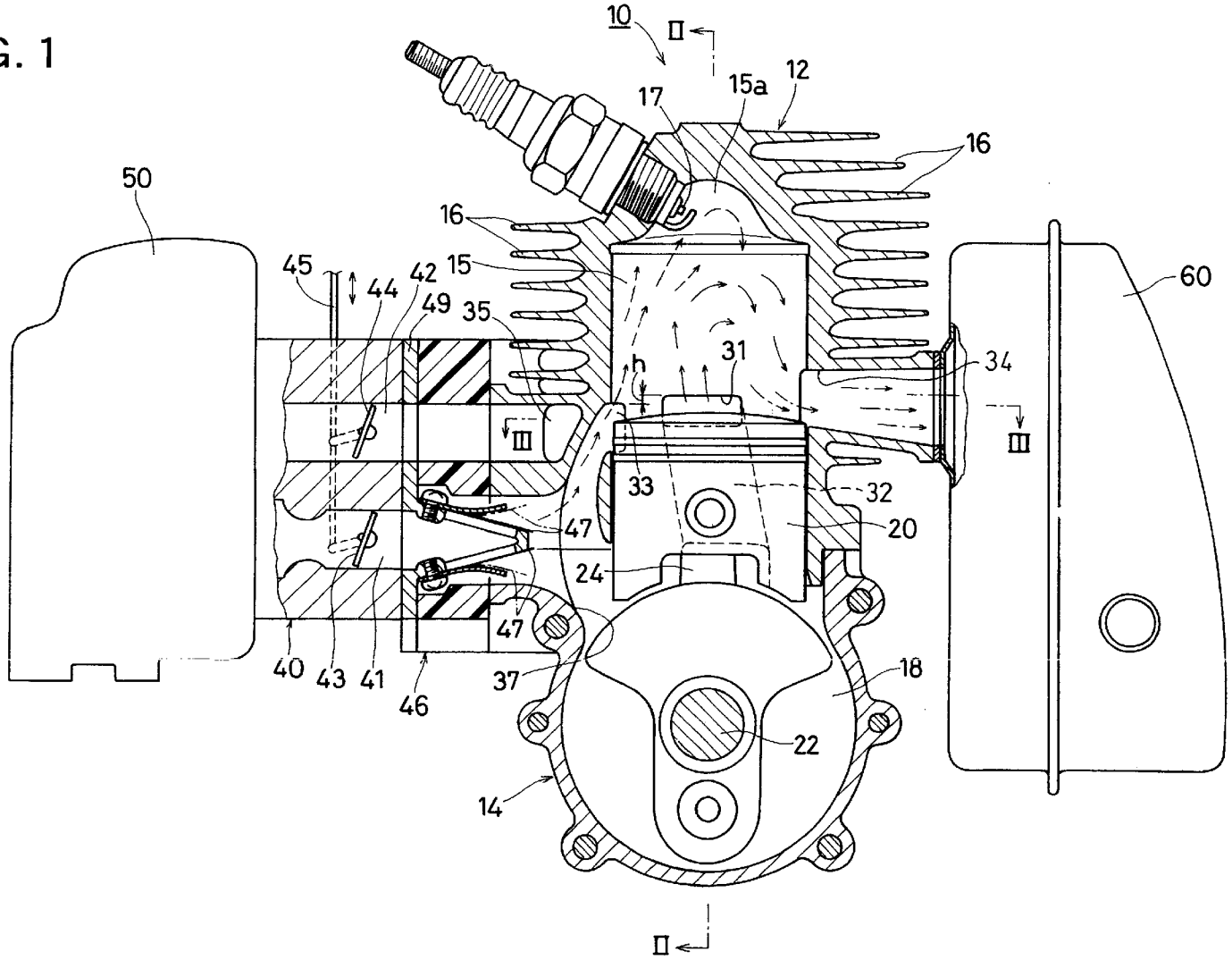
FIG. 1 is a longitudinal sectional view, illustrating one embodiment of a two-stroke internal combustion engine according to the present invention.

The present invention will be further explained with reference to the accompanying drawings, depicting one embodiment of the two-stroke internal combustion engine according to the present invention.

The embodiment of a two-stroke internal combustion engine 10 shown in the drawings is configured as a small air-cooled two-stroke gasoline engine, which is adapted to be employed in a portable working machine. The engine 10 comprises a cylinder 12, a piston 20 received in the cylinder 12 for axial movement, and a crankcase 14 supporting a crank shaft 22 for reciprocatively moving a piston 20 up and down through a connecting rod 24. The cylinder 12 is provided, on the outer circumferential wall thereof, with a large number of cooling fins 16, and, at the head portion thereof, with a squish-dome shape (semi-spherical) combustion chamber 15*a* at the upper end portion of a combustion/actuating chamber 15. An ignition plug 17 protrudes into the combustion chamber 15*a*.

Figure 2:
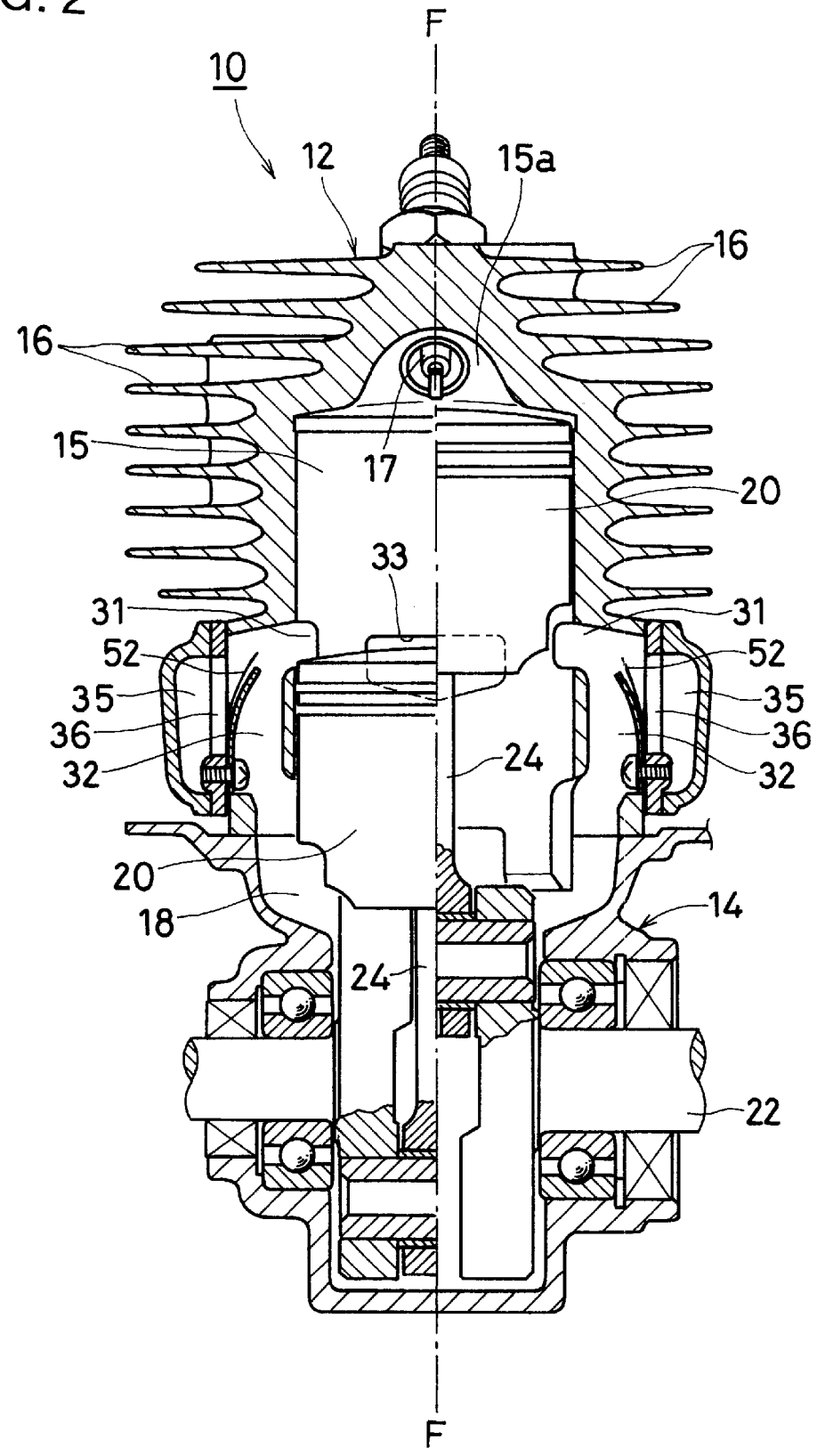
FIG. 2 is a cross-sectional view taken along the line II—II in FIG. 1.

An exhaust port 34 opens to the combustion/actuating chamber 15 at one side (the right side in FIG. 1) of a trunk portion of the cylinder 12. A pair of scavenging passageways 32, each of which communicates the combustion/actuating chamber 15 disposed above the piston 20 with the crankcase 18, are provided on both sides of the combustion/actuating chamber 15 symmetrically with respect to a longitudinal/axial plane (see section line F—F of FIG. 2) which bisects the exhaust port 34.

On the other side of the cylinder 12, opposite to where the exhaust port 34 is located (the left side in FIG. 1), there is mounted, by a bored heat insulator 46 and a valve-mounting plate 49, a carburetor 40, which serves as an air-fuel mixture-producing device. An air cleaner 50 is attached to the upstream side of the carburetor 40.

The carburetor 40 has an air passageway (upstream portion) 42 for conducting air to the scavenging passageways 32 and with an air-fuel supply passageway (upstream portion) 41 for conducting an air-fuel mixture to the combustion/actuating chamber 15. The air passageway 42 and the air-fuel supply passageway 41 are, respectively, provided with throttle valves 44 and 43, which are interlocked with each other by a link member 45.

The air passageway 42 and the air-fuel supply passageway 41 are arranged immediately adjacent each other, one above the other. The downstream part of the air passageway 42 leads to two branch passageways 35, each provided, at an air outlet port 36 at the downstream end thereof, with a stopper-attached reed valve 52 that functions as a check valve. The air-fuel supply passageway 41 is also provided, at a downstream part thereof, with a stopper-attached reed valve 47 that functions as a check valve, the reed valve 47 being attached to the valve-mounting plate 49.

The air-fuel supply passageway 41 is also provided, at the downstream end (upper end) thereof, with an air-fuel mixture-feeding port 33, which opens to the combustion/actuating chamber 15 disposed above the piston 20, thereby allowing the air-fuel mixture to be ejected from the air-fuel mixture-feeding port 33 in a generally upward direction toward the combustion chamber 15*a* of the combustion/actuating chamber 15. The air-fuel mixture is also introduced from the air-fuel supply passageway 41 into the crankcase 18 through a crankcase port 37.

Figure 5:
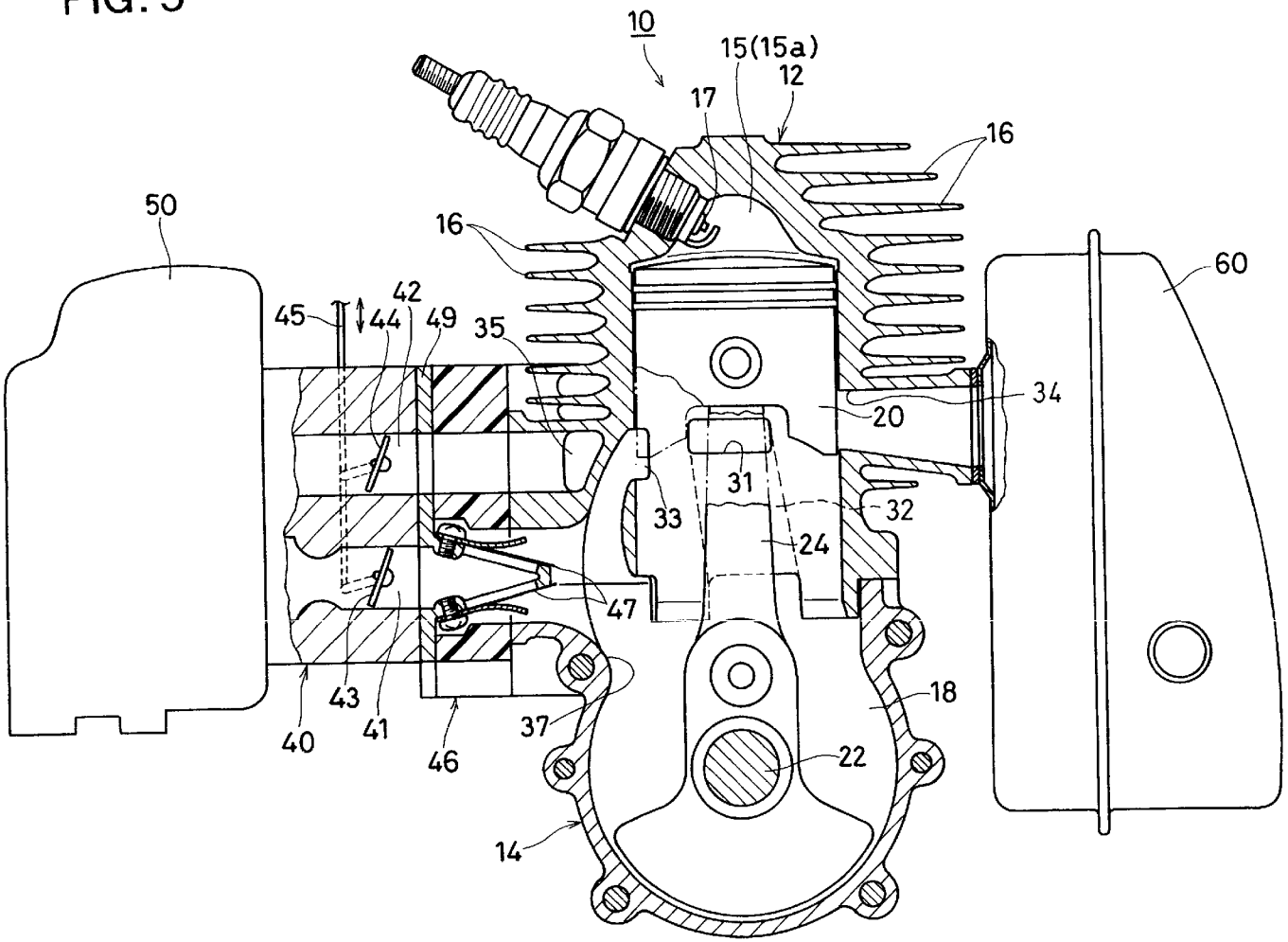
FIG. 5 is a longitudinal sectional view illustrating a state where the piston of the internal combustion engine shown in FIG. 1 is at the top dead center.

In the operation of the two-stroke internal combustion engine 10 of the embodiment, which is constructed as described above, external (ambient) air is inducted from the air passageway 42 through the air cleaner 50 and introduced into the pair of the right and left scavenging passageways 32 as well as into the crankcase 18 and stored therein during the ascending stroke of the piston 20 (FIG. 5 shows a state wherein the piston 20 is positioned at top dead center). Additionally, the air-fuel mixture is introduced from the carburetor 40 into part of the air-fuel supply passageway 41 and the crankcase 18 and stored therein.

Figure 3:
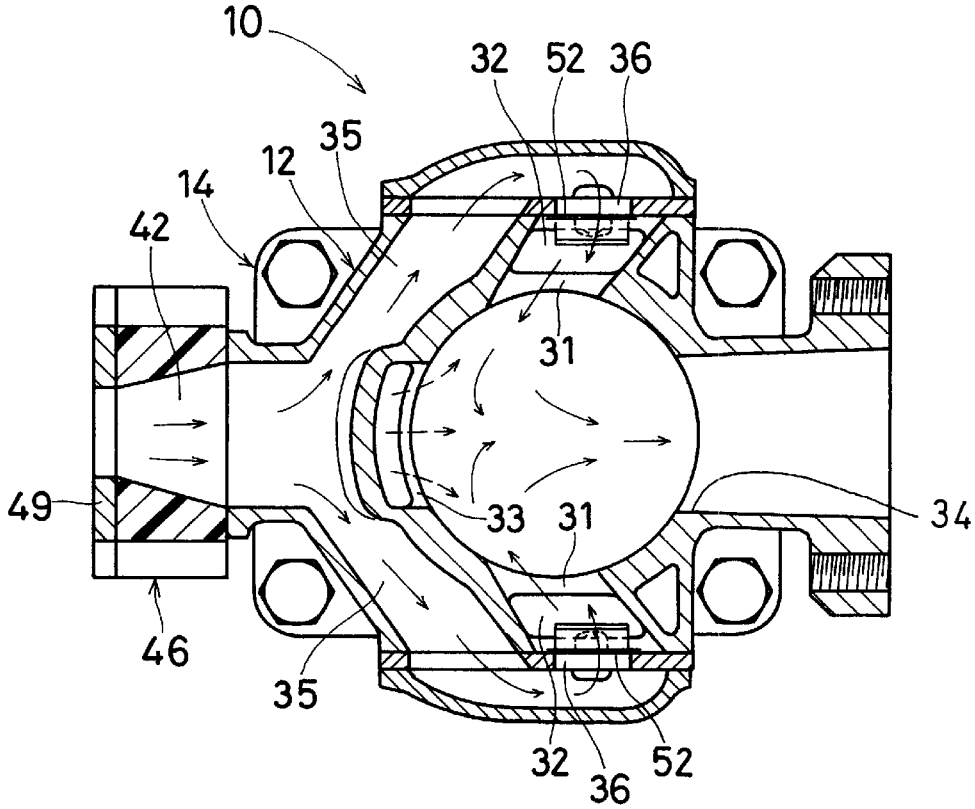
FIG. 3 is a cross-sectional view taken along the line III—III in FIG. 1.
Figure 4:
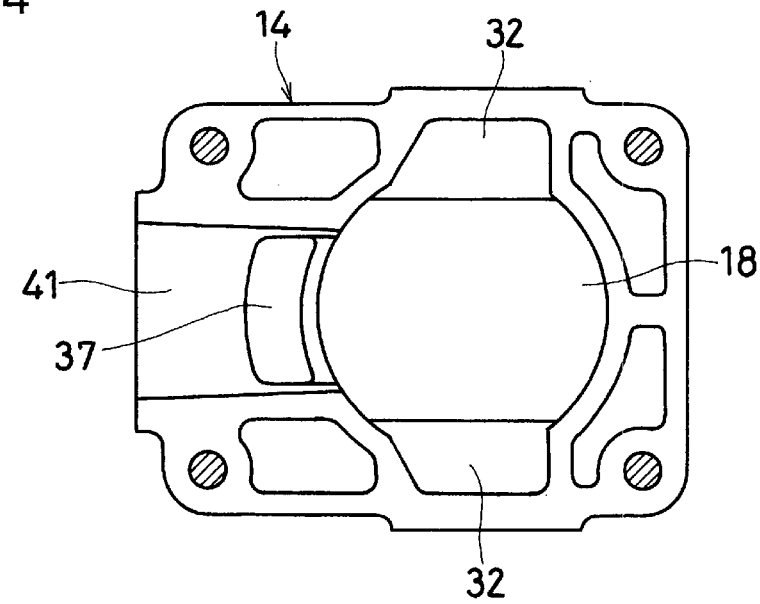
FIG. 4 is a plan view of only the crankcase shown in FIG. 1.

When the air-fuel mixture inside the combustion/actuating chamber 15 disposed above the piston 20 is ignited and burned, the piston 20 is pushed down due to the generation of a combustion gas. In the descending stroke of the piston 20, the exhaust port 34 opens first, and when the piston 20 has further descended, scavenging ports 31 formed at the upper end of the scavenging passageways 32 are opened so as to allow the air which has been stored in the scavenging passageways 32 and the crankcase 18 and compressed by the piston 20 to be blown from the scavenging ports 31 into the combustion/actuating chamber 15 disposed above the piston 20 (indicated by solid arrows in FIGS. 1 and 3), thereby allowing the combustion gas (indicated by dash-dot-dash arrows in FIG. 1) to be pushed toward the exhaust port 34 by the air.

When the piston 20 has further descended after the scavenging ports 31 have been opened, the air-fuel mixture-feeding port 33 is opened a moment after the scavenging ports 31 have been opened (for example, 10 degrees later in terms of the crank angle), thereby allowing the relatively condensed air-fuel mixture (indicated by dashed arrows in FIGS. 1 and 3) stored in the air-fuel supply passageway 41 to be blown from the air-fuel mixture-feeding port 33 into the combustion chamber 15*a* of the combustion/actuating chamber 15. The air-fuel mixture thus blown out is prevented from being mixed with the combustion gas due to the presence of an air layer that has been introduced therein in advance, thereby allowing the air-fuel mixture to revolve in the vicinity of the combustion chamber 15*a*.

Thereafter, following the supply of air from the scavenging passageways 32, a very lean air-fuel mixture comprising air and the air-fuel mixture is introduced from the scavenging ports 31 into the combustion/actuating chamber 15.

As mentioned above, since the air-fuel mixture-feeding port 33 is opened a moment later than the scavenging ports 31, thereby allowing a relatively condensed air-fuel mixture existing inside the air-fuel supply passageway 41 to be blown out of the air-fuel mixture-feeding port 33 toward the combustion chamber 15*a* of the combustion/actuating chamber 15, the air-fuel mixture thus blown out is prevented from being mixed with the combustion gas due to the presence of an air layer that has been introduced therein previously, thus enabling the air-fuel mixture to revolve in the vicinity of the combustion chamber 15*a*. As a result, the quantity of blow-by (the quantity of air-fuel mixture discharged without being utilized for the combustion) can be reduced as much as possible, and at the same time, the air-fuel mixture can be easily ignited, thus making it possible to improve the fuel consumption and to reduce the content of poisonous components in the exhaust gas.

Further, the introduction of the condensed air-fuel mixture from the air-fuel mixture-feeding port 33 to the combustion/actuating chamber 15 can be always effected (even after the movement of the piston 20 changes from the descending stroke to the ascending stroke) due to a difference in pressure between the combustion/actuating chamber 15 and the air-fuel supply passageway 41, so that before the air-fuel mixture-feeding port 33 is closed, the air-fuel mixture can be immediately delivered from the air-fuel mixture-feeding port 33 into the combustion/actuating chamber 15 through the air-fuel supply passageway 41 (or the check valve 47 thereof). As a result, the filling efficiency of the air-fuel mixture can be greatly improved, and at the same time, the power of the engine 10 can be increased.

Furthermore, since portions of the air supply passageway 42 and the air-fuel supply passageway 41 are arranged side by side, the parts of engine can be rationally and compactly arranged, thus making it possible to easily mount the engine on a portable power working machine.

While in the foregoing one embodiment of the present invention has been explained in detail for the purpose of illustration, it will be understood that the construction of the device can be varied without departing from the spirit and scope of the present invention.

For example, although the reed valves 52 are disposed at the downstream end of the air passageway 42 in the above embodiment, these check valves may be located on the upstream side of the air passageway 42 (for example, on the valve-mounting plate 49).

As seen from the above explanation, it is possible, according to the present invention, to provide a two-stroke internal combustion engine which is capable of minimizing the quantity of so-called blow-by or the quantity of air-fuel mixture to be discharged without being utilized for the combustion, of improving the fuel consumption and power of the engine, of reducing the content of undesirable components in the exhaust gas, and of rationally and compactly arranging the parts of engine.

What is claimed is:

1. A two-stroke internal combustion engine, comprising a cylinder, a piston received in the cylinder for reciprocating axial movement in ascending and descending directions and defining with the cylinder a combustion/actuating chamber, a crankcase, a carburetor for producing an air/fuel mixture, an air/fuel supply passageway arranged to receive the air/fuel mixture from the carburetor and to conduct it to the combustion/actuating chamber and opening to the combustion/actuating chamber at an air/fuel port, an exhaust passageway opening to the combustion/actuating chamber at an exhaust port, a scavenging passageway communicating the crankcase with the combustion/actuating chamber and opening to the combustion/actuating chamber at a scavenging port, and an air passageway arranged for introducing ambient air into the scavenging passageway, the carburetor including a portion of the air passageway and a portion of the air-fuel supply passageway, each such portion having a throttle valve, and the respective throttle valves being interlocked with each other, and wherein with respect to the descending stroke of the piston the exhaust port is positioned and configured to open before the scavenging port opens and the air/fuel port is positioned and configured to open after the scavenging port opens, whereby air is introduced into the combustion/actuating chamber prior to the introduction of the air-fuel mixture into the combustion/actuating chamber.

2. The two-stroke internal combustion engine according to claim 1, wherein portions of the air passageway and the air-fuel supply passageway are immediately adjacent each other.

3. The two-stroke internal combustion engine according to claim 1, wherein portions of the air passageway and the air-fuel supply passageway are arranged immediately adjacent each other and one above the other axially of the engine.

4. The two-stroke internal combustion engine according to claim 1, wherein the air passageway includes a check valve.

5. The two-stroke internal combustion engine according to claim 1, wherein the air-fuel supply passageway includes a check valve.

6. The two-stroke internal combustion engine according to claim 1, wherein the air-fuel passageway and port are configured to expel the air/fuel mixture toward a combustion chamber at the top of the combustion/actuating chamber.

7. The two-stroke internal combustion engine according to claim 1, and further comprising a second air-fuel supply passageway arranged to receive the air-fuel mixture from the carburetor and to discharge the air/fuel mixture into the crankcase.

8. The two-stroke internal combustion engine according to claim 1, further comprising:

a second scavenging passageway communicating the crankcase with the combustion/actuating chamber and opening to the combustion/actuating chamber at a second scavenging port, said first and second scavenging passageways and scavenging ports constituting the only scavenging passageways and scavenging ports communicating the crankcase with the combustion/actuating chamber; and said air passageway is arranged for introducing ambient air only directly into downstream regions of said first and second scavenging passageways.

* * * * *